US006821132B2

(12) United States Patent
Tomimori

(10) Patent No.: US 6,821,132 B2
(45) Date of Patent: Nov. 23, 2004

(54) STRUCTURE FOR ELECTRICALLY CONNECTING HIGH-VOLTAGE CIRCUIT BOARD TO ELECTRIC COMPONENT, HIGH-VOLTAGE SUPPLY ASSEMBLY, AND IMAGE FORMING APPARATUS PROVIDED WITH HIGH-VOLTAGE SUPPLY ASSEMBLY

(75) Inventor: Koshiro Tomimori, Yamatokoriyama (JP)

(73) Assignees: Kyocera Mita Corporation, Osaka (JP); Kyocera Corporation, Kyoto (JP)

( * ) Notice: Subject to any disclaimer, the term of this patent is extended or adjusted under 35 U.S.C. 154(b) by 67 days.

(21) Appl. No.: 10/277,519

(22) Filed: Oct. 22, 2002

(65) Prior Publication Data

US 2003/0109153 A1 Jun. 12, 2003

(30) Foreign Application Priority Data

Oct. 31, 2001 (JP) ..... 2001-335540

(51) Int. Cl.[7] ..... H01R 9/09
(52) U.S. Cl. ..... 439/76.1; 439/700
(58) Field of Search ..... 439/76.1 L, 92, 439/289, 700, 926

(56) References Cited

U.S. PATENT DOCUMENTS 1,935,268 A * 11/1933 Ireland ..... 200/51.1
5,192,216 A * 3/1993 Knauber et al. ..... 439/108
5,730,605 A * 3/1998 Glusker et al. ..... 439/67
6,176,710 B1 * 1/2001 Ewing et al. ..... 439/76.1
6,648,662 B2 * 11/2003 Shinzou et al. ..... 439/310

* cited by examiner

*Primary Examiner*—Thanh-Tam Le
(74) *Attorney, Agent, or Firm*—Jordan and Hamburg LLP

(57) ABSTRACT

An image forming apparatus, such as a copier and a printer, includes a structure or assembly for electrically connecting a high-voltage circuit board with an electric component of the image forming apparatus such as charger unit, developer unit and image transfer unit. The structure or assembly includes a circuit board attaching member which holds the high-voltage circuit board, and a contact terminal extending through the circuit board attaching member to be in contact with the high-voltage circuit board and the electric component for the electric connection therebetween. The contact terminal may have a rod shape and the circuit board attaching member may be formed with a cylindrical guide member having a through hole through which the contact terminal extends.

16 Claims, 6 Drawing Sheets

STRUCTURE FOR ELECTRICALLY CONNECTING HIGH-VOLTAGE CIRCUIT BOARD TO ELECTRIC COMPONENT, HIGH-VOLTAGE SUPPLY ASSEMBLY, AND IMAGE FORMING APPARATUS PROVIDED WITH HIGH-VOLTAGE SUPPLY ASSEMBLY

BACKGROUND OF THE INVENTION

1. Field of the Invention

This invention relates to an improvement in a structure for electrically connecting a high-voltage circuit board to an electric component in an image forming apparatus.

2. Description of the Related Art

Generally, an image forming apparatus is provided with circuit boards adapted to apply a high voltage to various electric components which need supply of a high voltage. Examples of such electric components are a charging unit for charging the surface of a photosensitive drum, a developing unit for supplying toner onto the drum surface, a transferring unit for transferring a toner image formed on the drum surface onto a copy sheet, and a separating unit for separating the toner image carrying sheet from the photosensitive drum. Hereinafter, the circuit board for supplying a high voltage to the electric component is called "high-voltage circuit board". The high-voltage circuit board is generally located away from the corresponding electric component to keep the electric component from being affected by an electromagnetic wave generated by the high-voltage circuit board. For the supply of a high voltage from the high-voltage circuit board to a electric component, the electric component is connected, by electric wires, with contact terminals which are in contact with the high-voltage circuit board.

In the conventional arrangement described above in which the high-voltage circuit board are located away from the corresponding ones of the electric components in such a manner that each of the electric components and the corresponding high-voltage circuit board are connected by electric wires, failure in electric conduction is likely to occur due to incomplete coupling of connectors upon connection of the electric wires to the electric component or the high-voltage circuit board, or incomplete fastening of the contact terminal. Furthermore, the conventional arrangement requires the high-voltage circuit board and the electric wires to be coated with a shielding member to keep peripheral devices including the electric component, from being adversely affected by an electromagnetic wave generated by the high-voltage circuit board and the electric wires, whereby the number of parts constituting the image forming apparatus resultantly increases, lowering efficiency in assembling the image forming apparatus, and raising production cost of the image forming apparatus.

SUMMARY OF THE INVENTION

In view of the above, it is an object of the present invention to provide an image forming apparatus in which a high voltage circuit board is electrically connected with an electric component in a sophisticated way.

It is another object of the present invention to provide an image forming apparatus which includes a structure for electrically connecting high-voltage circuit board with an electric component of the image forming apparatus for supplying high-voltage to the electric component, with the structure being less liable to incomplete connection or failure in electric conduction.

It is still another object of the present invention to provide an image forming apparatus in which a high-voltage circuit board is electrically connected with an electric component, with the influence of electromagnetic wave caused by the high-voltage circuit board being effectively prevented while the circuit board being located relatively close to the electric component.

It is further object of the present invention to provide an improved structure for the electric connection between a high voltage circuit board and an electric component to supply a high voltage from the high-voltage circuit board to the electric component in an image forming apparatus.

It is still further object of the present invention to provide a structure for an electric connection between a high-voltage circuit board and an electric component of an image forming apparatus with the influence of electromagnetic wave caused by the high-voltage circuit board being effectively prevented while the circuit board being located relatively close to the electric component.

According to an aspect of this invention, an image forming apparatus comprises a structure or an assembly for electrically connecting a high-voltage circuit board with an electric component of the image forming apparatus. The structure or assembly includes a circuit board attaching member which holds the high-voltage circuit board, and a contact terminal extending through the circuit board attaching member to be in contact with the high-voltage circuit board and the electric component for the electric connection therebetween.

According to another aspect of the present invention, the contact terminal may have a rod shape and the circuit board attaching member may be formed with a cylindrical guide member having a through hole through which the contact terminal extends.

According to still another aspect of the present invention, a positioning hole is formed on the high-voltage circuit board, and the circuit board attaching member is formed with an engaging portion engageable with the positioning hole to position the high-voltage circuit board relative to the circuit board attaching member.

According to further aspect of the present invention, the structure or assembly for the electric connection may further comprises a grounding member for grounding the high-voltage circuit board, and the circuit board attaching member may include a grounding member holding portion for holding the grounding member thereon, with the grounding member being in contact with the high-voltage circuit board and being exposed out of the circuit board attaching member when the high-voltage circuit board is coupled with the circuit board attaching member.

In the above arrangement, since the high-voltage circuit board and the electric component are directly and electrically connected by the contact terminal, occurrence of inferior electric communication between the high-voltage circuit board and the electric component is suppressed. Further, since the high-voltage circuit board and the contact terminal are mounted on the main body of the image forming apparatus in a state that the circuit board attaching member covers the high-voltage circuit board and the contact terminal when the high-voltage circuit board is allowed to be electrically connected to the electric component, peripheral devices including the electric component are kept from being adversely affected by an electromagnetic wave generated from the high-voltage circuit board. This arrangement enables to dispose the high-voltage circuit board closer to or adjacent to the electric component, which makes it possible to construct a high voltage supply assembly for supplying a high voltage from the high-voltage circuit board to the electric component in a small space. Furthermore, the above arrangement makes it possible to directly and electrically connect the high-voltage circuit board to the electric component by way of the contact terminal without using an electric wire. This arrangement enables to decrease the number of parts required for connecting the high-voltage circuit board to the electric component while keeping the peripheral devices including the electric component from being adversely affected by an electromagnetic wave generated by the high-voltage circuit board.

These and other objects, features and advantages of the present invention will become more apparent upon a reading of the following detailed description and accompanying drawing.

DESCRIPTION OF THE PREFERRED EMBODIMENTS

Figure 1:
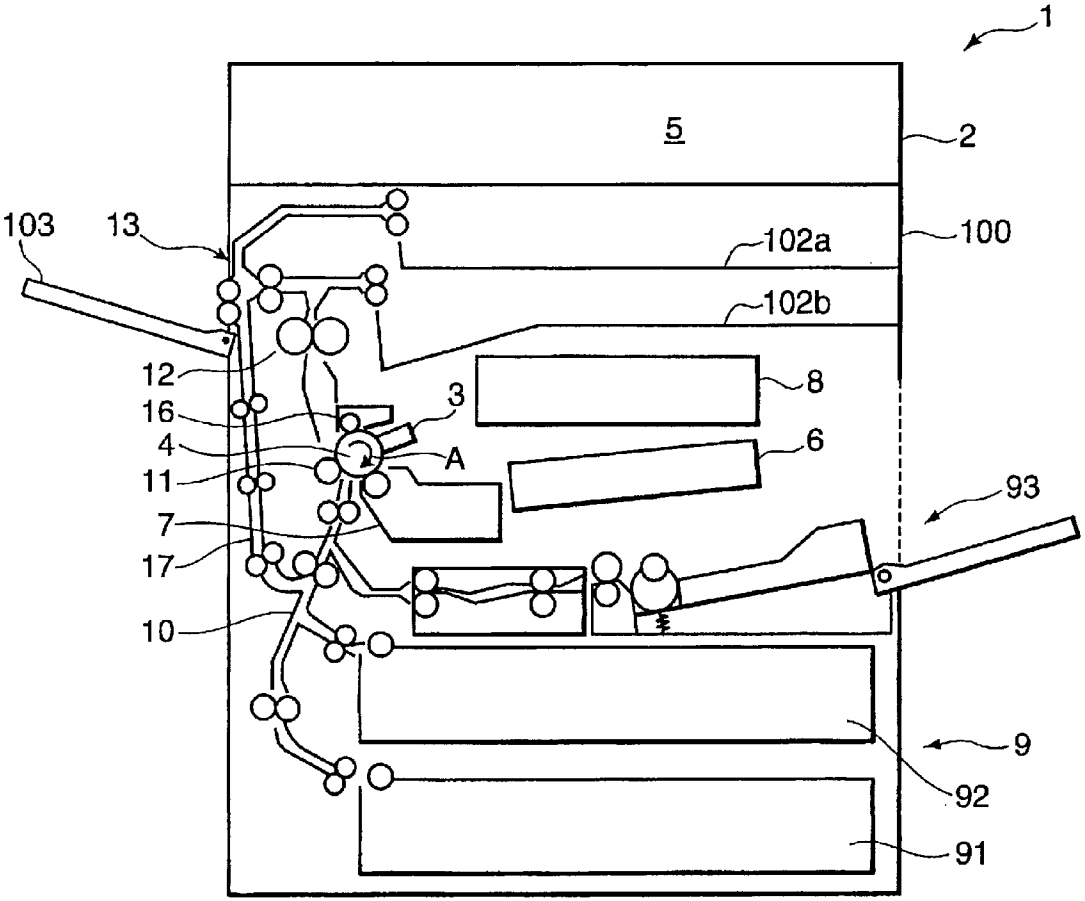
FIG. 1 is schematic illustration of an image forming apparatus to which a high-voltage supply assembly according to an embodiment of this invention is applied.

A structure for electrically connecting a high-voltage circuit board to an electric component in an image forming apparatus, and a high-voltage supply assembly embodying this invention are described with reference to the accompanying drawings. FIG. 1 is a schematic illustration showing an image forming apparatus to which a structure for electrically connecting a high-voltage circuit board to an electric component in an image forming apparatus, and a high-voltage supply assembly according to an embodiment of this invention are applied.

Referring to FIG. 1, a copier 1 is shown as an example of the image forming apparatus according to the embodiment of this invention. In a main body 2 of the copier 1, a photosensitive drum 4 is rotated in the direction of the arrow A and is uniformly charged by a charger 3 on its surface. A document reader 5 reads the image of original document, and a laser beam bearing the data of the read image and emitted from an exposure unit 6 irradiates the surface of the drum 4 and an electrostatic latent image is formed on the surface of the drum 4. Toner supplied from a toner container 8 is adhered to the latent image by the developer 7 to develop a toner image from the latent image.

A copy sheet is dispensed from a copy sheet storage section 9 and is transported via a sheet transport path 10 to the photosensitive drum 4 which carries the toner image on the surface thereof. The toner image is transferred to the copy sheet from the surface of the drum while the copy sheet is being transported through between the drum 4 and a transfer roller 11 with the transfer roller 11 pressing the copy sheet against the surface of the drum 4. After the transfer of the toner image, the copy sheet is separated from the drum surface, and is transported to a fixing unit 12 which includes a pair of fixing rollers for image fixation. After the image is fixed on the copy sheet at the fixing unit 12, the copy sheet is transported to a sheet transport path 13 which has a plurality of branch routes. The copy sheet transported to a junction of the plural branch routes of the sheet transport path 13 is directed to a specified branch route by a sheet transport route selection member. In case of a single-side image formation, the copy sheet is discharged onto one of an upper tray 102*a*, a lower tray 102*b*, and a sheet tray 103 of a sheet discharge section 100. In case of a double-sided image formation, the copy sheet transported to the junction of the sheet transport path 13 is fed to a sheet transport path 17 for image formation on opposite side of the sheet and is finally discharged onto one of the trays 102*a*, 102*b*, and 103 of the sheet discharge section 100 after the image formation on both sides of the sheet.

Electric components which need supply of a high voltage such as the charger 3, the developer 7, the transfer roller 11, and a separator (not shown) for separating a copy sheet from the photosensitive drum 4 are each electrically connected to a high-voltage circuit board for the supply of a high voltage. The structure for electrically connecting a high-voltage circuit board to an electric component of an image forming apparatus, and the high-voltage supply assembly according to the embodiment of this invention are adapted to such electric connection between each of the electric components and the corresponding high-voltage circuit board.

Reference numeral 16 denotes a cleaning unit for removing toner residues remaining on the surface of the photosensitive drum 4. The copy sheet storage section 9 is detachably attached to the copier main body 2, and includes sheet cassettes 91 and 92 each adapted for storing copy sheets of a predetermined size therein, and a bypass stacker (bypass tray) 93 arranged above the sheet cassette 92. The sheet cassettes 91 and 92, and the bypass tray 93 are communicated, by the sheet transport path 10, with an image forming assembly comprising the photosensitive drum 4 and the developer 7.

Figure 2:
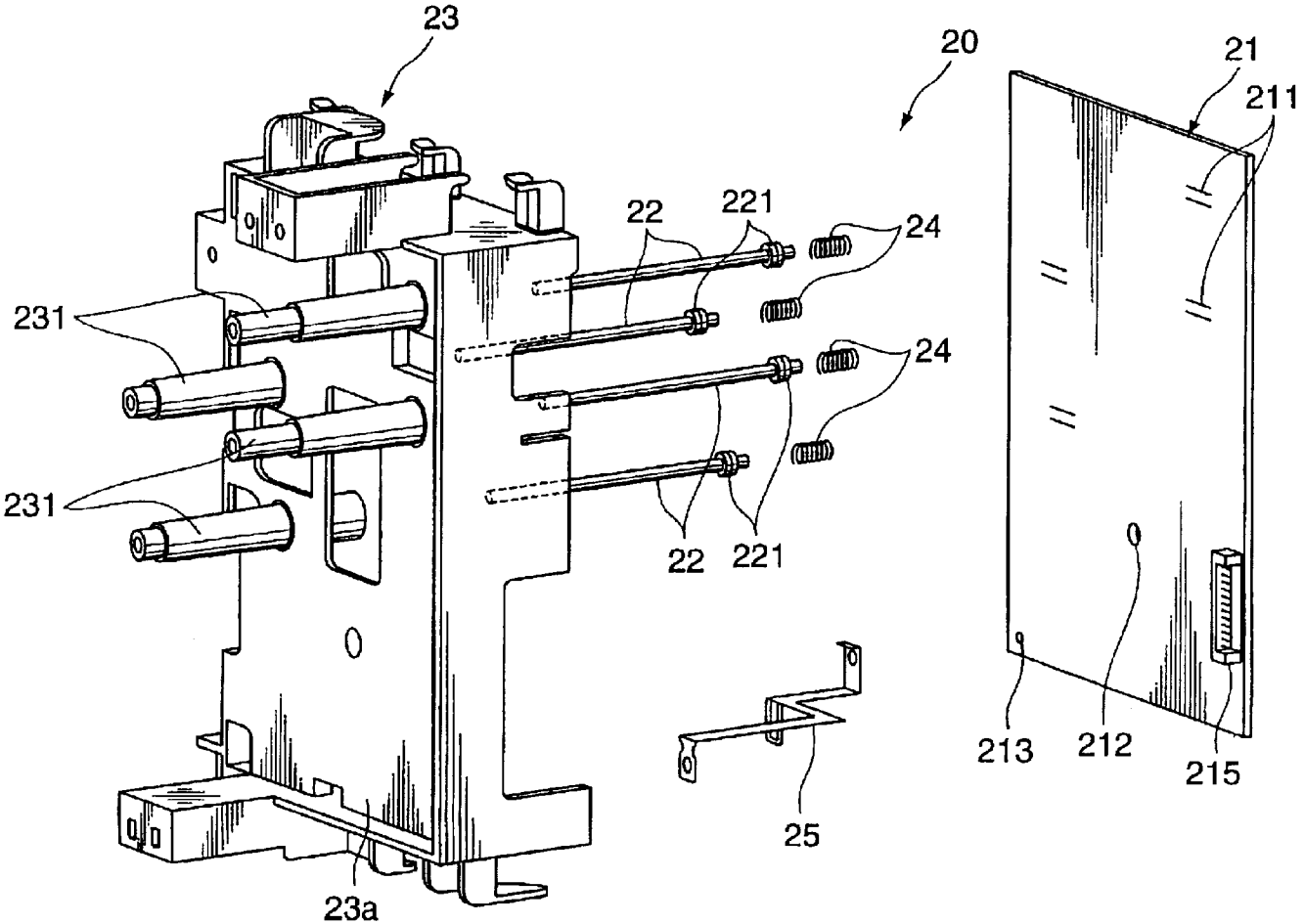
FIG. 2 is an exploded perspective view of the high-voltage supply assembly as seen from the front of a circuit board attaching member.
Figure 3:
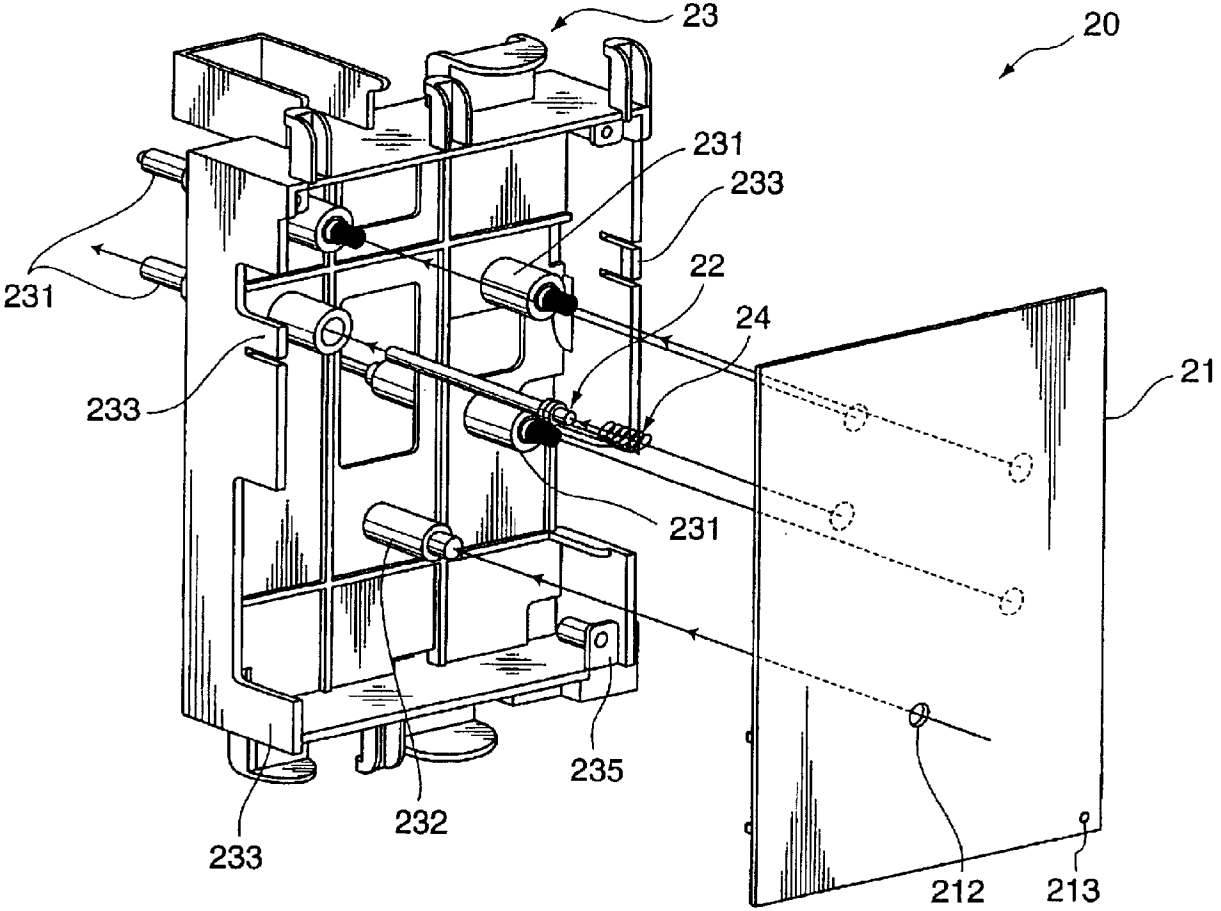
FIG. 3 is an exploded perspective view of the high-voltage supply assembly as seen from the rear of the circuit board attaching member.

Next, description will be made about the structure for electrically connecting a high-voltage circuit board to an electric component in the image forming apparatus, and the high-voltage supply assembly according to the embodiment of this invention. FIGS. 2 and 3 are exploded perspective views each showing the high-voltage supply assembly as seen from the front and rear of the assembly, and FIG. 4 is a perspective view of the high-voltage supply assembly in an assembled state.

Figure 4:
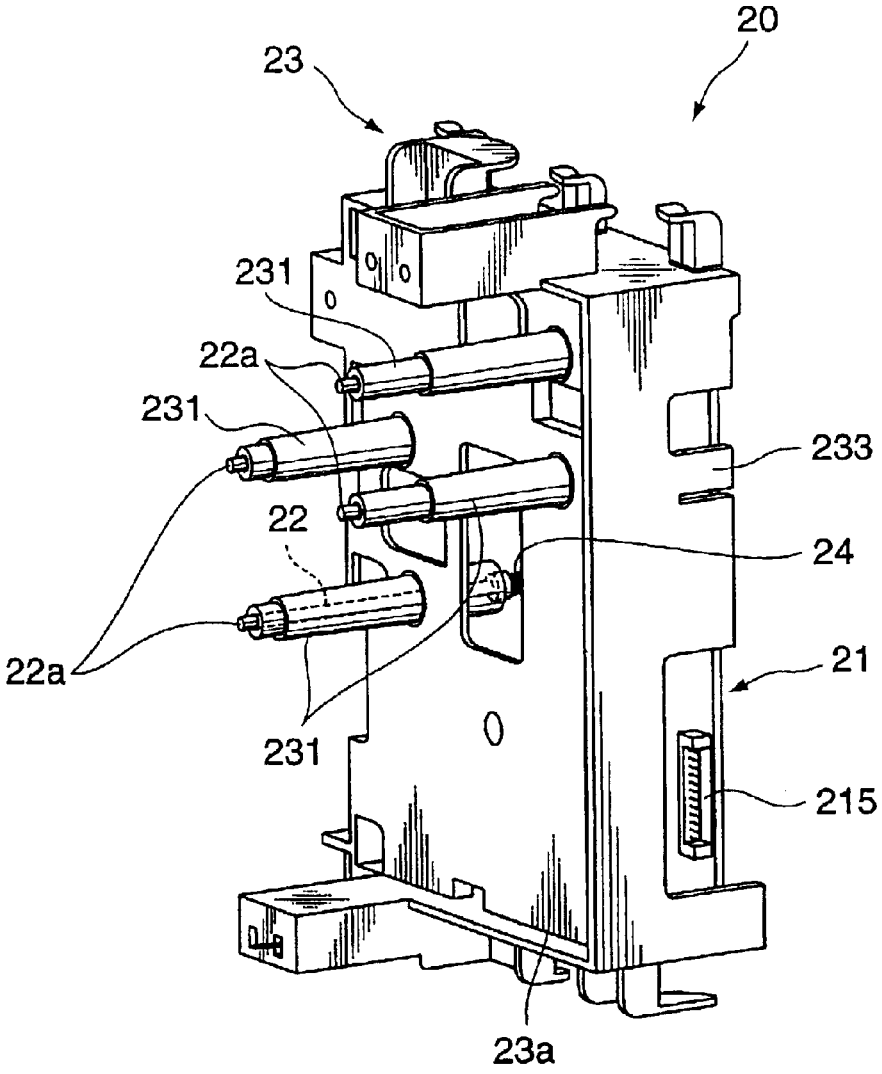
FIG. 4 is a perspective view of the high-voltage supply assembly in an assembled state.

Referring to FIGS. 2 through 4, a high-voltage supply assembly 20 includes a high-voltage circuit board 21 (hereinafter, simply called "circuit board 21") for supplying a high voltage to one of the electric components of the copier 1 which needs supply of a high voltage, a plurality of contact terminals 22 adapted for electrically connecting the circuit board 21 to the electric component, and a circuit board attaching member 23 for supportively mounting the circuit board 21 on the copier main body 2 in a state that the surface of the circuit board 21 carrying electric parts thereon is covered with the circuit board attaching member 23. The circuit board attaching member 23 is so constructed as to hold the circuit board 21 and the contact terminals 22 in a state that all the contact terminals 22 are rendered in contact with the circuit board 21.

The circuit board 21 is formed with contacts 211 each of which is rendered in contact with the corresponding one of the contact terminals 22 for electrical connection. The circuit board 21 is also formed with a positioning hole 212 for positioning the circuit board 21 relative to the circuit board attaching member 23, and a screw hole 213 for fastening the circuit board 21 on the circuit board attaching member 23 with a grounding member 25 interposed therebetween, as will be described later. The circuit board 21 is further provided with a connector 215 for connecting the circuit board 21 to an electric power source (not shown). It should be appreciated that the position of each contact 211 is optimally determined considering the position of the corresponding contact on the electric component to be connected.

The circuit board attaching member 23 is provided with contact terminal guide members 231 into each of which the corresponding one of the contact terminals 22 is inserted. Each contact terminal guide member 231 projects from a backside of the circuit board attaching member 23, i.e. the surface facing the electric component (leftward side in FIGS. 2 and 4). Hereinafter, the side where the circuit board 21 is provided is called "circuit board side", and the side where the electric component is provided, namely, the side opposite from the circuit board side, is called "electric-component side". Each contact terminal guide member 231 has a hollow portion in which the corresponding one of the contact terminals 22 is inserted. The contact terminal guide member 231 has a length to cover the sum of the length of the contact terminal 22 and a length corresponding to an expected axial travel of the contact terminal 22 in the contact terminal guide member. Thus, the contact terminal guide member 231 is so configured as to smoothly guide the contact terminal 22 therethrough.

Each contact terminal guide member 231 is provided with a compression spring 24 (urging member) for urging the contact terminal 22 in a direction toward the electric-component side. The contact terminal 22 extends through the contact terminal guide member 231 to be guided thereby with the compression spring 24 being mounted on an end portion of the contact terminal 22 on the circuit board side. Each contact terminal 22 is formed with a projection or flange 221 which engages the compression spring 24. When the contact terminals 22 are inserted and assembled into the contact terminal guide members 231 with the compression spring being coupled with the contact terminal 22 and the compression spring engaging the projections 221 respectively, the contact terminals 22 are urged toward the electric-component side due to an elastic force generated by the compression springs 24. As a result, electrical connection between the contact terminals 22 and the electric component is ensured with each of the contact terminals 22 being subject to a contact pressure.

The circuit board attaching member 23 is formed with a positioning boss 232 which fits in the positioning hole 212 of the circuit board 21. The position of the positioning boss 232 is so determined as to align the contact terminal guide members 231 and the contact terminals 22 respectively with the corresponding contacts 211 of the circuit board 21 when a tip end of the positioning boss 232 is fitted in the positioning hole 212 of the circuit board 21.

The circuit board attaching member 23 is formed with circuit board supporting guides 233 which engage the opposite lateral sides of the circuit board 21 to hold the circuit board 21. Engagement of the circuit board supporting guides 233 with the opposite lateral side parts of the circuit board 21 secures the circuit board 21 on the circuit board attaching member 23. The position of the positioning boss 232 is also determined such that the opposite lateral sides of the circuit board 21 match the corresponding circuit board supporting guides 233 respectively when the tip end of the positioning boss 232 is fitted in the positioning hole 212. Engagement of the positioning boss 232 with the positioning hole 212 accomplishes both of the positioning of the circuit board 21 relative to the circuit board attaching member 23 and the positioning of the contacts 211 of the circuit board 21 relative to the contact terminals 22 accommodated in the contact terminal guide members 231.

The circuit board attaching member 23 is formed with a grounding member holding portion 235 for holding the grounding member 25. The grounding member holding portion 235 is adapted to hold the grounding member 25 with the grounding member 25 being in contact and in electrical connection with the circuit board 21 when the circuit board 21 is attached to the circuit board attaching member 23. A screw (not shown) is threaded into the screw hole 213 of the circuit board 21 and fastened therein with the grounding member 25 being interposed between the circuit board attaching member 23 and the circuit board 21 to thereby fasten the circuit board attaching member 23, the grounding member 25, and the circuit board 21 with one another.

The grounding member 25 is to be exposed out of the circuit board attaching member 23 and the circuit board 21 when the grounding member 25 is fixedly supported between the circuit board 21 and the circuit board attaching member 23. The part of the grounding member 25 exposed out of the circuit board attaching member 23 may be connected with a grounding wire (not shown) provided on the copier main body 2 to ground the circuit board 21 easily with the circuit board 21 of the high-voltage supply assembly 20 mounted on the copier main body 2.

Now, described is how the high-voltage supply assembly 20 is assembled. First, the contact terminals 22 are inserted in the corresponding contact terminal guide members 231 of the circuit board attaching member 23 with the compression spring 24 being attached to the tip end of each contact terminal 22. Next, the grounding member 25 is fixedly supported on the grounding member holding portion 235 of the circuit board attaching member 23. Then, the circuit board 21 is mounted on the circuit board attaching member 23 with the positioning boss 232 of the circuit board attaching member 23 being fitted into the positioning hole 212 of the circuit board 21 and the circuit board supporting guides 233 being brought into engagement with the opposite lateral sides of the circuit board 21, respectively, whereby the circuit board 21 is fixedly coupled to the circuit board attaching member 23.

In this way, the contact terminals 22 are brought into contact with the corresponding contacts 211 on the circuit board 21 for electric connection when the circuit board 21 is held by the circuit board attaching member 23. As shown in FIG. 4, when the circuit board 21 is fixedly held in the circuit board attaching member 23, an end part 22*a* of each contact terminal 22 protrudes out of the corresponding one of the contact terminal guide members 231. The end portions 22*a* of the contact terminals 22 protruding out of the contact terminal guide members 231 are connected to the respective contacts of the electric component to thereby electrically connect the circuit board 21 with the electric component.

Figure 5:
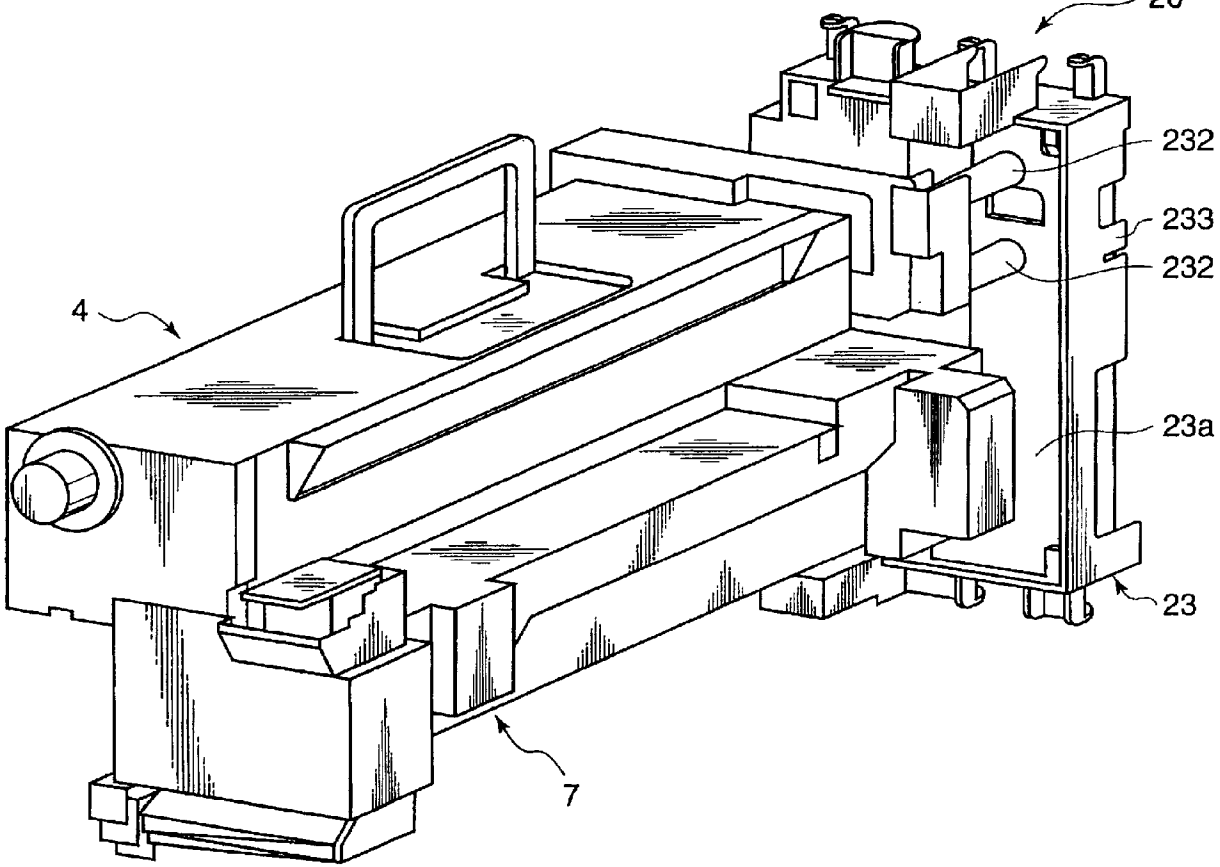
FIG. 5 is a perspective view illustrating interrelationship between the high-voltage supply assembly and the electric component of the image forming apparatus, with the main body of image forming apparatus being removed for the convenience of illustration of the relationship.
Figure 6:
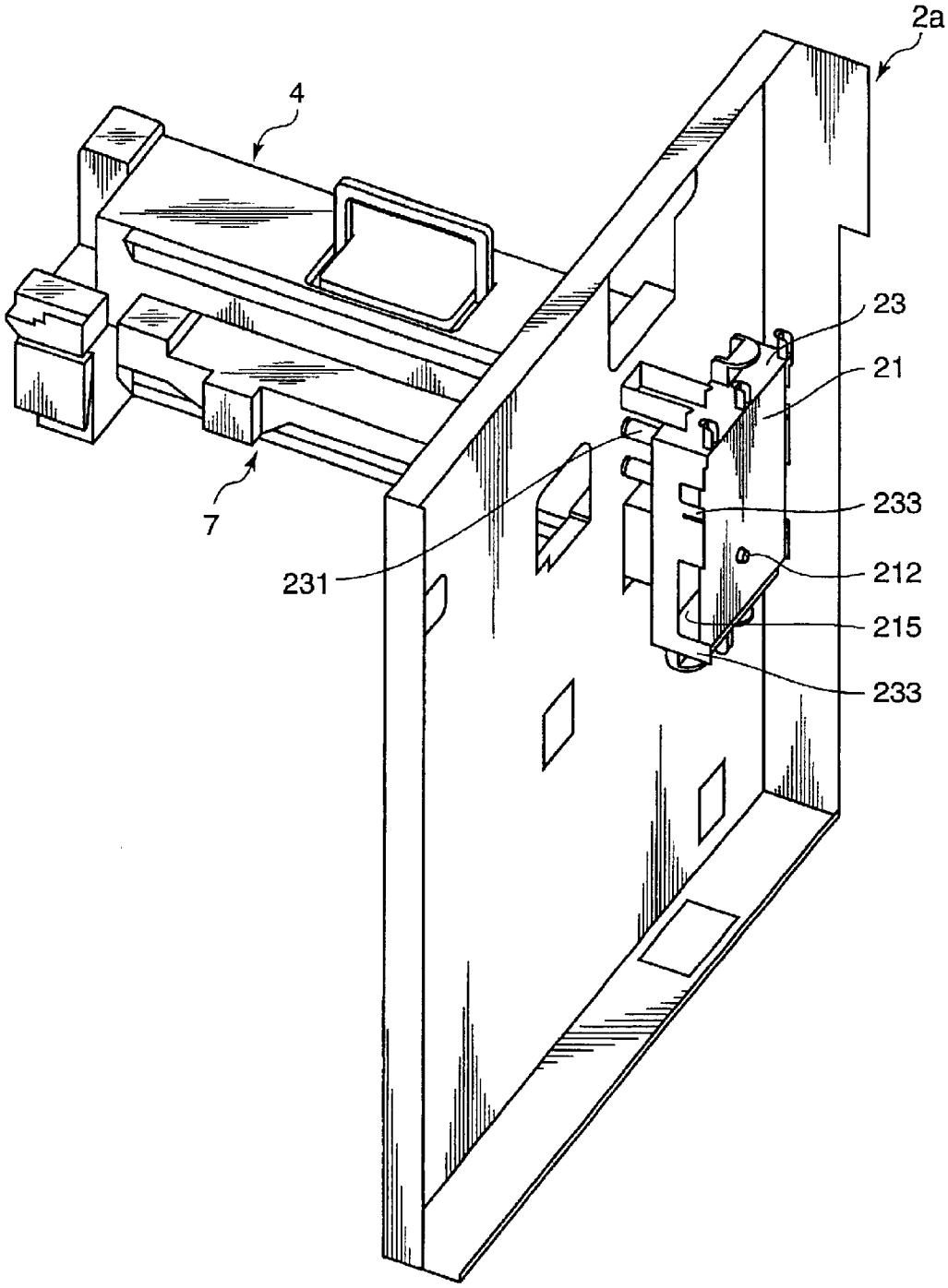
FIG. 6 is a perspective view illustrating how the high-voltage supply assembly is attached to the main body of the image forming apparatus and coupled with the electric component.

Next, described is how the high-voltage supply assembly 20 is mounted on the main body 2 of the copier 1, with reference to FIGS. 5 and 6.

FIG. 5 shows how the high-voltage supply assembly 20 is coupled with the electric components 4 and 7. It is to be noted that FIG. 5 does not show a frame of the copier 1 as a portion of its main body for the convenience of illustration. The frame is interposed between the high-voltage supply assembly 20 and the electric components 4 and 7, as will be described later with reference to FIG. 6.

Referring to FIG. 5, the high-voltage supply assembly 20 is coupled with the photosensitive drum unit 4 and developer unit 7. The charger 3 is incorporated in the photosensitive drum unit 4. The contact terminals 22 extending through the guide members 231 abut against the photosensitive drum unit 4 at its end plane and are in contact with corresponding terminals on the plane.

Referring to FIG. 6, the high-voltage supply assembly 20 is mounted on the frame 2*a* of the main body 2 of the copier 1 with the backside surface 23*a* (see FIG. 4) facing the copier main body 2 (namely, facing the electric-component side) in a state that the surface of the circuit board 21 carrying various electric parts thereon faces the electric-component side and is covered by the circuit board attaching member 23. The frame 2*a* is mechanically connected with the photosensitive drum unit 4 and developer unit 7.

When the high-voltage supply assembly 20 is mounted on the frame 2*a* of the copier main body 2, the contact terminal guide members 231 extend through the frame 2*a*. Accordingly, the contact terminals 22 extending through the contact terminal guide members 231 pass through the circuit board attaching member 23 and the frame 2*a*, and the end portions 22*a* of the contact terminals 22 protruding out of the contact terminal guide members 231 are rendered into contact with the corresponding contacts of the electric component for electrical connection. Mounting of the high-voltage supply assembly 20 on the copier main body 2 accomplishes electrical connection between the contact terminals 22 and the contacts of the electric component and between the contact terminals 22 and the contacts 211 of the circuit board 21 simultaneously.

When the high-voltage supply assembly 20 is mounted on the main body 2 of the copier 1, the circuit board attaching member 23 of the high-voltage supply assembly 20 and the frame 2*a* of the main body 2 are interposed between the circuit board 21 of the high-voltage supply assembly 20 and the electric component since the backside surface 23*a* of the circuit board attaching member 23 is in contact with the main body 2 when the high-voltage supply assembly 20 is mounted on the main body 2. This arrangement allows both of the circuit board attaching member 23 and the copier main body 2 to serve as an electromagnetic wave blocker for blocking the peripheral devices including the electric component from being adversely affected by an electromagnetic wave generated by the circuit board 21.

In summary, according to an embodiment of the present invention, the circuit board and the electric component are directly and electrically connected by the contact terminals. Further, the electric connection is secured between the contact terminals and the circuit board and between the contact terminals and the electric component. Accordingly, occurrence of inferior electric conduction is suppressed between the circuit board and the electrical component. It is to be understood that the present invention is not limited to the structure for electrically connecting a circuit board to an electric component in an image forming apparatus, but may also be directed to the high-voltage supply attachment, and the image forming apparatus equipped with the high-voltage supply attachment, According to another aspect of this invention, the circuit board and the contact terminals are mounted on the main body of the copier in a state that the circuit board and the contact terminals are covered with the circuit board attaching member. In addition, the circuit board attaching member and the main body of the copier are interposed between the circuit board and the electric component. These arrangements effectively suppress the peripheral devices including the electric component, from being adversely affected by an electromagnetic wave generated by the circuit board, and enables location of the high-voltage supply attachment adjacent to or close to the electric component, thereby enabling reduction of the space for accommodating the structure for supplying a high voltage from the circuit board to an electric component.

Further, the arrangement of the above mentioned embodiment enables direct and electrical connection of the circuit board and the electric component by way of the contact terminals without usage of an electric wire or its equivalent. This arrangement keeps the peripheral devices including the electric component from being adversely affected by an electromagnetic wave generated by electric wire, as having been encountered in the conventional art.

According to yet another aspect of this invention, the circuit board attaching member is formed with the contact terminal guide members each having a certain length and such a configuration as to guide the corresponding one of the contact terminals. A compression spring is mounted on each contact terminal for urging the contact terminal in a direction opposite from the circuit board, namely, toward the electric-component side, with the contact terminals respectively fitted in the corresponding one of the contact terminal guide members. With this arrangement, each of the contact terminals is rendered in electrical connection with the electric component with a certain contact pressure exerted thereto to thereby secure the connected state between the electric component and the contact terminals. In addition to this, the insertion of the contact terminals into the corresponding contact terminal guide members of the circuit board attachment enables precise positioning of the contact terminals relative to the corresponding contacts on the circuit board, respectively. This arrangement eliminates or reduces inferior electric connection between the circuit board and the electric component due to a poor contact state between the circuit board and the contact terminals as was seen in conventional devices.

According to still another aspect of this invention, the circuit board attaching member is formed with the positioning boss at a position corresponding to the positioning hole on the circuit board. Engagement of the positioning boss with the positioning hole enables to position the circuit board relative to the circuit board attaching member, thereby facilitating positioning of the circuit board to the circuit board attaching member.

It should be appreciated that this invention is not limited to the foregoing embodiment, and various modifications and alterations are applicable without departing from the scope and spirit of the invention as defined by attached claims. Followings are examples of such modifications or alternations.

(1) In the above embodiment, the circuit board 21 is positioned relative to the circuit board attaching member 23 by fitting the tip end of the positioning boss 232 of the circuit board attaching member 23 in the positioning hole 212 of the circuit board 21. Alternatively, the positioning boss 232 and the positioning hole 212 may be omitted.

(2) In the above embodiment, the grounding member holding member 235 is provided on the circuit board attaching member 23. Alternatively, the grounding member holding member 235 may be omitted.

(3) In the above embodiment, when the contact terminals 22 mounted with the compression springs 24 are inserted in the contact terminal guide member 231, each of the contact terminals 22 is rendered in contact with the circuit board 21 and with the electric component at a certain contact pressure. As an altered arrangement, the compression springs 24 may be omitted, and each of the contact terminals 22 without the compression springs 24 may be rendered in contact with the circuit board 21 and the electric component with no contact pressure exerted thereto.

This application is based on Japanese patent application No. 2001-335540 filed on Oct. 31, 2001, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A structure for electrically connecting a high-voltage circuit board to an electric component of an image forming apparatus, the high-voltage circuit board bearing a circuit component at least on a component bearing surface, and the image forming apparatus having a main body, the structure comprising:

a rod-shaped contact terminal for electrically connecting the high-voltage circuit board to the electric component; and a circuit board attaching member for supporting the high-voltage circuit board and the contact terminal while securing a contact between the high-voltage circuit board and the contact terminal and covering the component bearing surface of the high-voltage circuit board, the circuit board attaching member being attached to the main body of the image forming apparatus with the component bearing surface of the high-voltage circuit board opposing the electric component, said circuit board attaching member including a contact terminal guide member having a cylindrical shape and a through hole through which said contact terminal extends such that the contact terminal extends through the circuit board attaching member and is in contact with the high-voltage circuit board and the electric component for electric connection therebetween.

2. The structure according to claim 1, wherein an urging member is associated with the contact terminal to urge the contact terminal against the electric component for pressing contact and the electrical connection between the high-voltage circuit board and the electric component.

3. The structure according to claim 1, wherein a positioning hole is formed on the high-voltage circuit board, and the circuit board attaching member has a positioning boss engageable with the positioning hole to position the high-voltage circuit board relative to the circuit board attaching member.

4. The structure according to claim 1, further comprising a grounding member for electrically grounding the high-voltage circuit board, and wherein the circuit board attaching member includes a grounding member holding portion for holding the grounding member thereon, with the grounding member being in contact with the high-voltage circuit board and being exposed out of the circuit board attaching member when the high-voltage circuit board is coupled with the circuit board attaching member.

5. The structure according to claim 3, further comprising a grounding member for electrically grounding the high-voltage circuit board, and wherein the circuit board attaching member includes a grounding member holding portion for holding the grounding member thereon, with the grounding member being in contact with the high-voltage circuit board and being exposed out of the circuit board attaching member when the high-voltage circuit board is coupled with the circuit board attaching member.

6. A high voltage supply assembly adapted to be mounted on an image forming apparatus for electrically connecting a high-voltage circuit board to an electric component of the image forming apparatus, the high-voltage circuit board bearing a circuit component at least on a component bearing surface, and the image forming apparatus having a main body, the assembly comprising:

a rod-shaped contact terminal for electrically connecting the high-voltage circuit board to the electric component; and a circuit board attaching member for supporting the high-voltage circuit board and the contact terminal while securing a contact between the high-voltage circuit board and the contact terminal and covering the component bearing surface of the high-voltage circuit board, the circuit board attaching member being attached to the main body of the image forming apparatus with the component bearing surface of the high-voltage circuit board opposing the electric component, said circuit board attaching member including a contact terminal guide member having a cylindrical shape and a through hole through which said contact terminal extends such that the contact terminal extends through the circuit board attaching member and is in contact with the high-voltage circuit board and the electric component for electric connection therebetween.

7. An image forming apparatus comprising:

an electric component provided in the image forming apparatus;

a high-voltage circuit board for supplying a high voltage to the electric component and having an electric part bearing surface on which an electric part is mounted, a rod-shaped contact terminal for electrically connecting the high-voltage circuit board to the electric component; and a circuit board attaching member coupled with the high-voltage circuit board for holding the high-voltage circuit board and the contact terminal and covering the electric part bearing surface of the high-voltage circuit board, said circuit board attaching member including a contact terminal guide member having a cylindrical shape and a through hole through which said contact terminal extends such that the contact terminal extends through the circuit board attaching member and is in contact with the high-voltage circuit board and the electric component for electric connection therebetween.

8. The image forming apparatus according to claim 7, wherein an urging member is associated with the contact terminal to urge the contact terminal against the electric component for pressing contact and the electrical connection between the high-voltage circuit board and the electric component.

9. The image forming apparatus according to claim 7, wherein a positioning hole is formed on the high-voltage circuit board, and the circuit board attaching member has a positioning boss engageable with the positioning hole to position the high-voltage circuit board relative to the circuit board attaching member.

10. The image forming apparatus according to claim 7, further comprising a grounding member for electrically grounding the high-voltage circuit board, and wherein the circuit board attaching member includes a grounding member holding portion for holding the grounding member thereon, with the grounding member being in contact with the high-voltage circuit board and being exposed out of the circuit board attaching member when the high-voltage circuit board is coupled with the circuit board attaching member.

11. The image forming apparatus according to claim 8, wherein the main body of the image forming apparatus includes a frame member interposed between the electric component and the circuit board attaching member, and the contact terminal guide member extends through the frame of the main body of the image forming apparatus such that the contact terminal extends through the circuit board attaching member and the frame of the main body of the image forming apparatus.

12. The image forming apparatus according to claim 11, wherein the rod shaped contact terminal fits and extends through the through hole of the contact terminal guide member with opposite end portions of the contact terminal projecting from the guide member.

13. The image forming apparatus according to claim 12, wherein the urging member is interposed between the contact terminal and the high-voltage circuit board such that the contact terminal abuts against the electric component and the high-voltage circuit board under the pressure of the urging member.

14. The image forming apparatus according to claim 11, wherein the circuit board attaching member is fixed on the frame of the main body of the image forming apparatus, with the circuit board attaching member fixedly holding the high-voltage circuit board.

15. The image forming apparatus according to claim 7, wherein the circuit board attaching member further includes circuit board supporting guides engageable with opposite lateral side parts of the high-voltage circuit board to secure the high-voltage circuit board on the circuit board attaching member.

16. The image forming apparatus according to claim 15, wherein the circuit board attaching member has a one-side open box shape to enclose the electric part bearing surface of the high-voltage circuit board.

* * * * *